US006877266B1

(12) United States Patent
Brownlee

(10) Patent No.: US 6,877,266 B1
(45) Date of Patent: Apr. 12, 2005

(54) FIREARM SUPPORT APPARATUS

(76) Inventor: Wally Brownlee, 1110 1st Ave. SE., Watertown, SD (US) 57201

( * ) Notice: Subject to any disclaimer, the term of this patent is extended or adjusted under 35 U.S.C. 154(b) by 187 days.

(21) Appl. No.: 10/441,324

(22) Filed: May 19, 2003

(51) Int. Cl.[7] ..... F41A 27/00

(52) U.S. Cl. ..... 42/94; 42/90; 89/37.01; 89/37.04

(58) Field of Search ..... 42/90, 94; 89/37.01–37.04; 248/286.1, 125.1, 177.1, 186.1

(56) References Cited

U.S. PATENT DOCUMENTS

| | | | | | |
|---|---|---|---|---|---|
| 691,912 | A | | 1/1902 | Mcclean | |
| 3,041,938 | A | | 7/1962 | Seabrook | 89/37 |
| D203,680 | S | * | 2/1966 | Allison | D22/108 |
| 3,827,172 | A | * | 8/1974 | Howe | 42/94 |
| 3,947,988 | A | | 4/1976 | Besaw | 42/94 |
| 4,026,057 | A | * | 5/1977 | Cady | 42/94 |
| 4,409,751 | A | * | 10/1983 | Goda et al. | 42/94 |
| 4,449,314 | A | | 5/1984 | Sorensen | 42/94 |
| 4,854,066 | A | * | 8/1989 | Canterbury, Sr. | 42/94 |
| 4,924,616 | A | * | 5/1990 | Bell | 42/94 |
| 4,971,208 | A | * | 11/1990 | Reinfried et al. | 211/64 |
| 4,972,619 | A | * | 11/1990 | Eckert | 42/94 |
| 4,998,944 | A | | 3/1991 | Lund | 42/94 |
| 5,070,636 | A | * | 12/1991 | Mueller | 42/94 |
| 5,081,783 | A | | 1/1992 | Jarvis | 42/94 |
| 5,497,575 | A | | 3/1996 | Fried | 42/94 |
| 5,628,135 | A | | 5/1997 | Cady | 42/94 |
| 5,661,919 | A | * | 9/1997 | Pryor | 42/94 |
| 5,778,589 | A | * | 7/1998 | Teague | 42/94 |
| 5,933,999 | A | * | 8/1999 | McClure et al. | 42/94 |
| 6,044,747 | A | * | 4/2000 | Felts | 89/40.06 |
| 6,293,041 | B1 | | 9/2001 | Weaver | 42/94 |
| 6,305,117 | B1 | * | 10/2001 | Hales, Sr. | 42/94 |
| 6,338,218 | B1 | * | 1/2002 | Hegler | 42/94 |
| D471,248 | S | | 3/2003 | Jacobs | D22/108 |
| 6,526,687 | B1 | | 3/2003 | Looney | 42/94 |
| 6,546,662 | B1 | * | 4/2003 | Chong | 42/94 |
| 6,574,899 | B1 | * | 6/2003 | Mostello | 42/94 |

* cited by examiner

*Primary Examiner*—Lulit Semunegus
(74) *Attorney, Agent, or Firm*—Leonard & Proehl, Prof. L.L.C.; Robert K. Huck

(57) ABSTRACT

A firearm support apparatus for supporting a firearm during the discharge of the firearm. The firearm support apparatus includes a front support assembly being designed for being positioned on a support surface. The front support assembly is designed for engaging and supporting a front portion of the firearm above the support surface. The front assembly is designed for altering an angle of the firearm with respect to a target to accommodate for wind. A rail assembly is operationally coupled to the front support assembly whereby the front support assembly is selectively positionable along a length of the rail assembly. A rear support assembly is operationally coupled to the rail assembly opposite the front support assembly. The rear support assembly is designed for supporting a rear portion of the firearm when the front portion of the firearm is supported by the front support assembly.

20 Claims, 4 Drawing Sheets

FIREARM SUPPORT APPARATUS

BACKGROUND OF THE INVENTION

1. Field of the Invention

The present invention relates to firearm supports and more particularly pertains to a new firearm support apparatus for supporting a firearm during the discharge of the firearm.

2. Description of the Prior Art

The use of firearm supports is known in the prior art. U.S. Pat. No. 5,628,135 describes a device for supporting a firearm during discharge of the firearm. Another type of firearm support is U.S. Pat. No. 6,526,687 having a fore stock support assembly and a butt stock support assembly that are support from a support surface to support a firearm. U.S. Pat. No. 4,409,751 has a barrel support for supporting a barrel of a firearm and a stock support for supporting the stock of the firearm while the firearm is being discharged. U.S. Pat. No. 691,912 has a mount that is selectively coupled to a gun to support the gun while the gun is being discharged. U.S. Pat. No. 3,041,938 has a magnetic holding means for engaging the metal parts of the firearm to inhibit movement of the firearm with respect to the gun rest. U.S. Pat. No. 3,947,988 has a portable rifle rest that that can be placed on a surface and support a rifle while the rifle is being sighted in. U.S. Pat. No. 4,449,314 has a support with front and rear support members for supporting the firearm. U.S. Pat. No. 4,924,616 has a portable firearm rest with a T-shaped base and a fore rest to receive the barrel of the firearm with a recoil slide to absorb the recoil when the firearm is fired. U.S. Pat. No. 5,497,575 has a riffle support apparatus for supporting a rifle above a support surface during discharge of the firearm. U.S. Pat. No. 5,081,783 has a device for supporting a firearm during discharge of the firearm and to facilitate sighting of the firearm. U.S. Pat. No. 4,998,944 has a mechanism for supporting a gun that allows for adjustment of the barrel of the gun. U.S. Pat. No. 6,293,041 has a rifle rest for support a rifle and allows for the rifle to be rotated and tilted as desired by the user. U.S. Pat. No. Des. 471,248 shows a rifle rest.

While these devices fulfill their respective, particular objectives and requirements, the need remains for a device that has certain improved features allowing for the accommodation of wind during discharge of the firearm.

SUMMARY OF THE INVENTION

The present invention meets the needs presented above by providing block members that support the front portion of the firearm and are selectively positioned side to side concurrently to allow the user to compensate for wind.

Still yet another object of the present invention is to provide a new firearm support apparatus that allows the rear support assembly to pivot to prevent the firearm from binding between the block members when the user adjusts the block members to compensate for the wind.

Even still another object of the present invention is to provide a new firearm support apparatus that provide front support members that can be utilized on flat surfaces or can be partially imbedded into the support surface to support the firearm.

To this end, the present invention generally comprises a front support assembly being designed for being positioned on a support surface. The front support assembly is designed for engaging the firearm whereby the front support assembly is for supporting a front portion of the firearm above the support surface. The front assembly is designed for altering an angle of the firearm with respect to a target to accommodate for wind. A rail assembly is operationally coupled to the front support assembly whereby the front support assembly is selectively positionable along a length of the rail assembly. A rear support assembly is operationally coupled to the rail assembly opposite the front support assembly. The rear support assembly is designed for supporting a rear portion of the firearm when the front portion of the firearm is supported by the front support assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
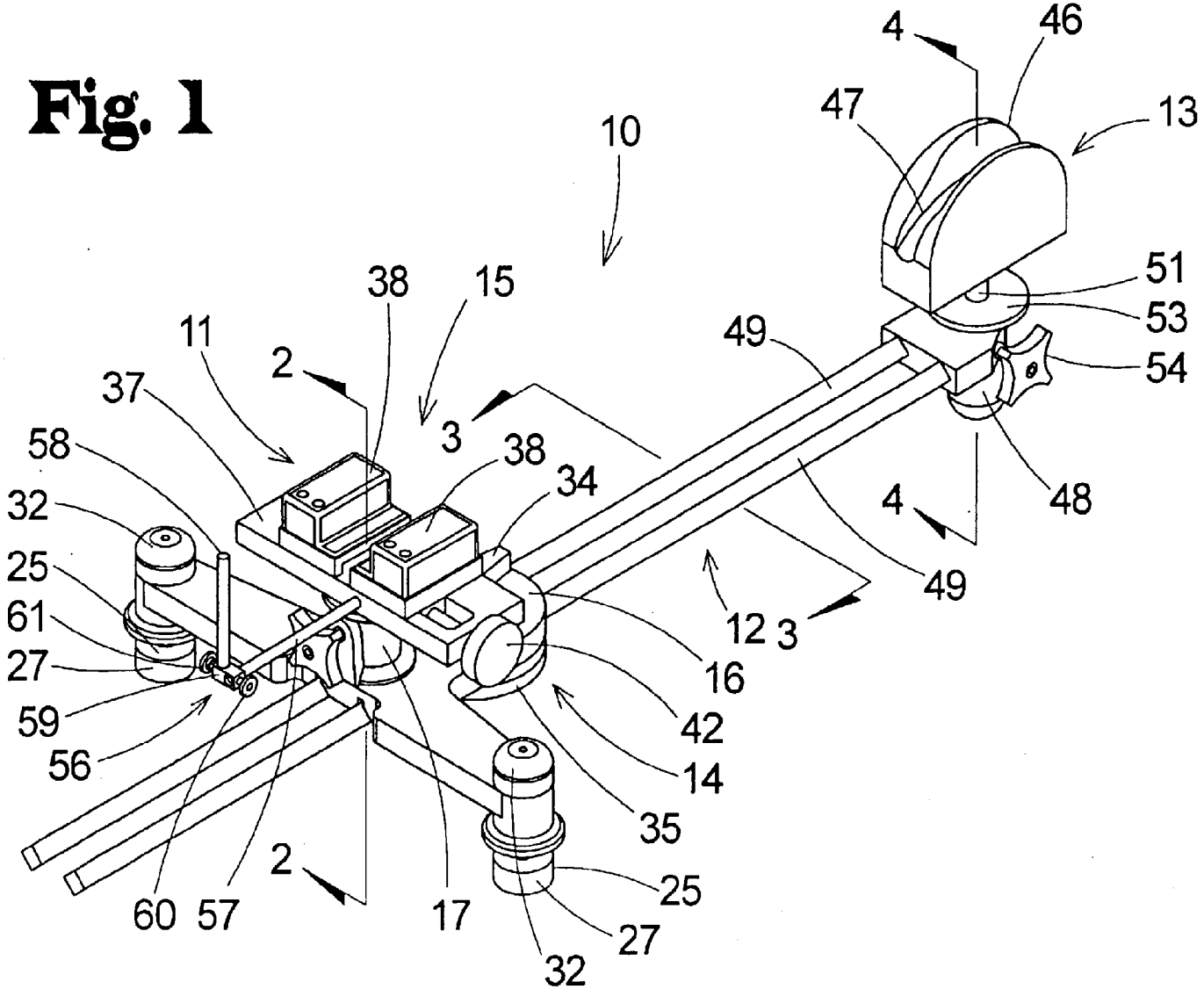
FIG. 1 is a perspective view of a new firearm support apparatus according to the present invention.
Figure 2:
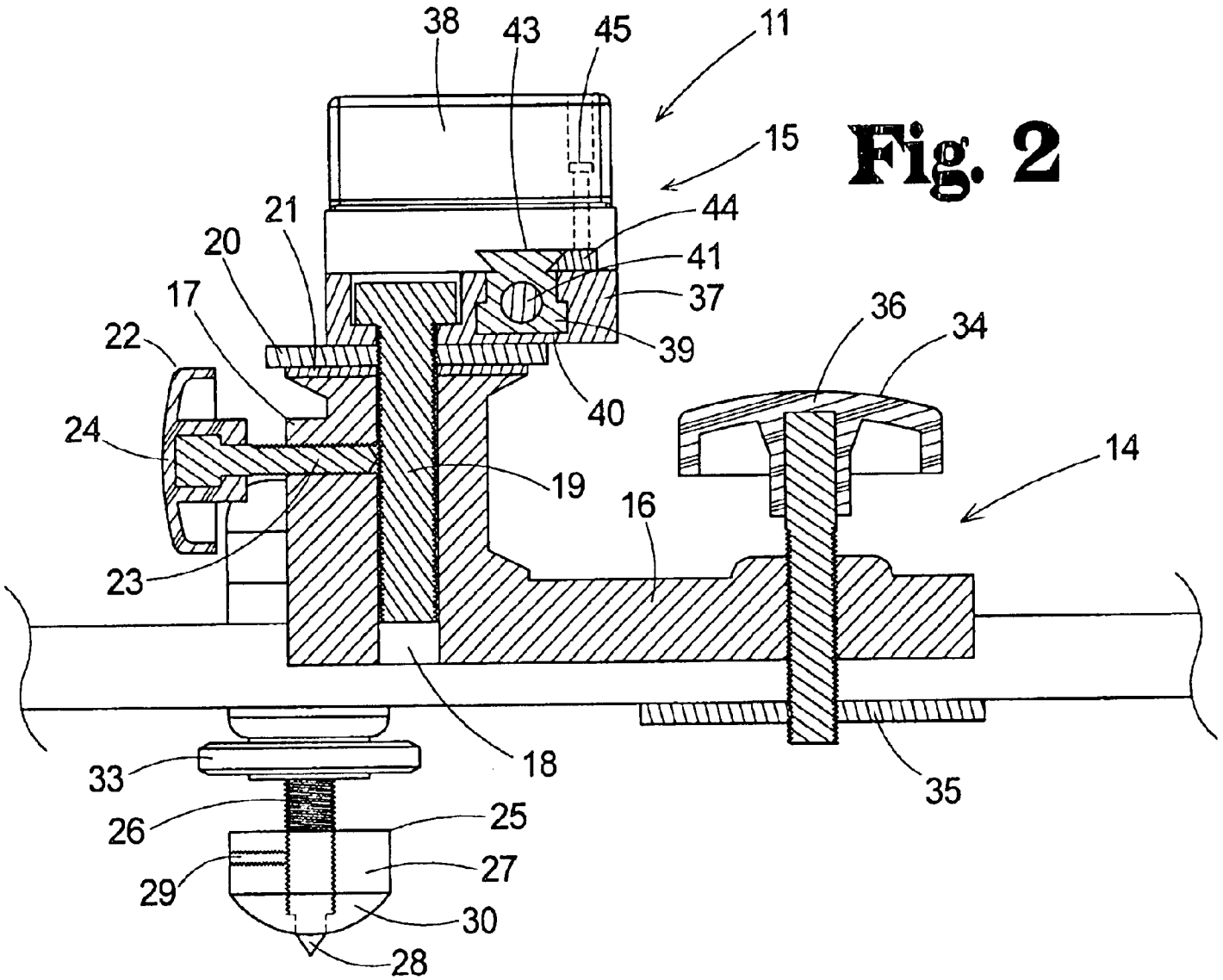
FIG. 2 is a cross-sectional view of the present invention taken alone line 2—2 of FIG. 1.
Figure 3:
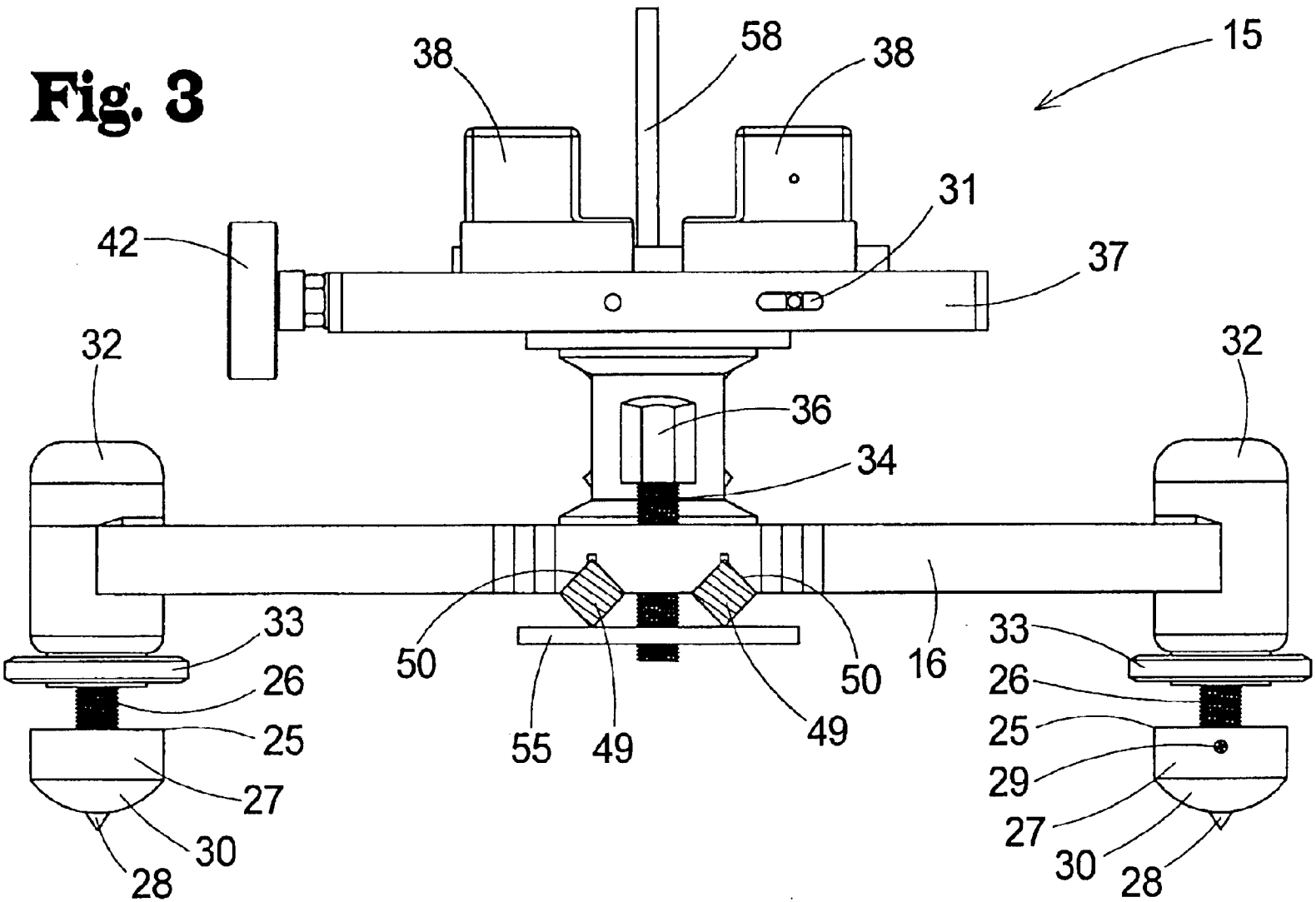
FIG. 3 is a cross-sectional view of the present invention taken along line 3—3 of FIG. 1.
Figure 4:
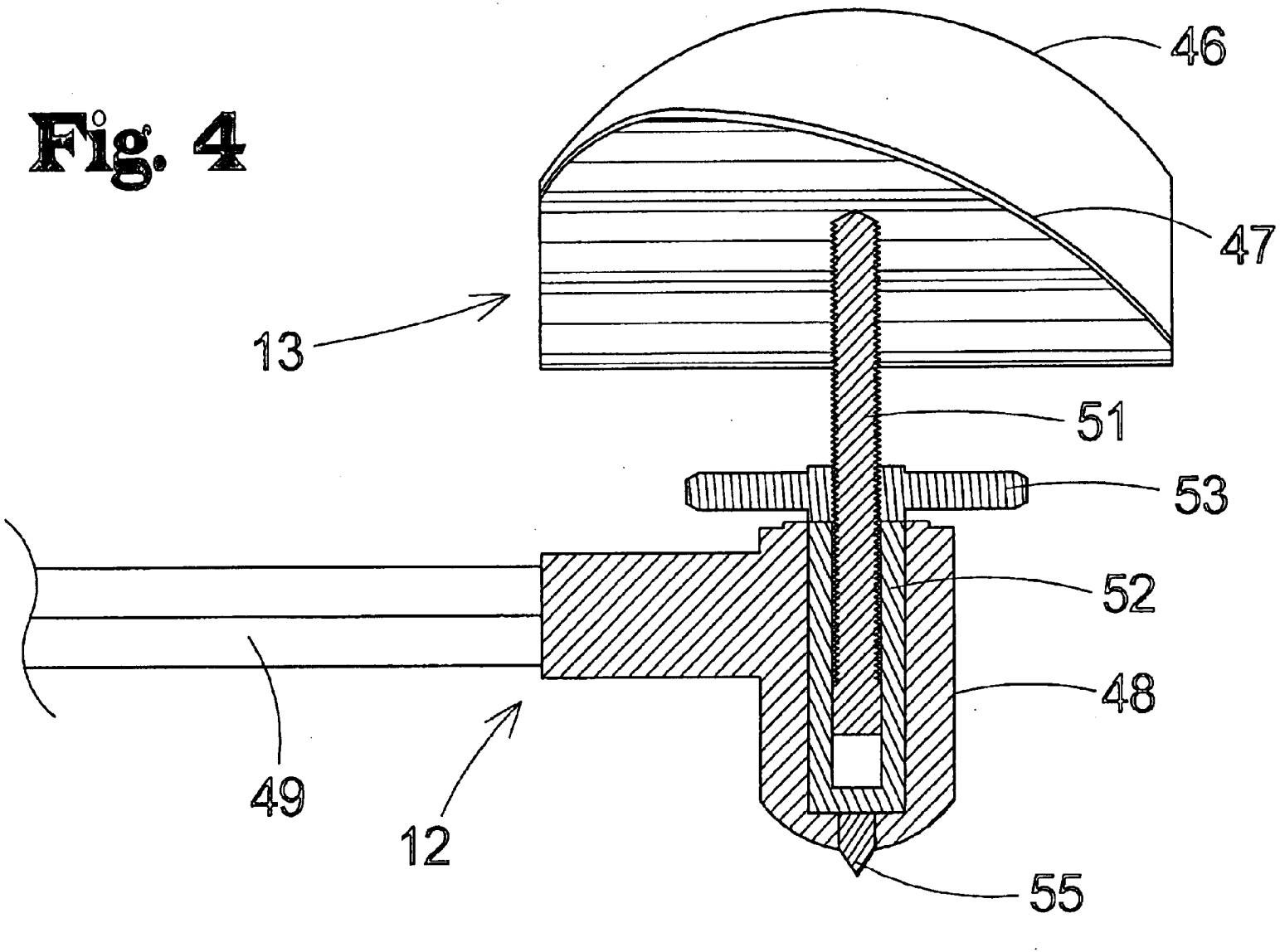
FIG. 4 is a cross-sectional view of the present invention taken along line 4—4 of FIG. 1.

With reference now to the drawings, and in particular to FIGS. 1 through 4 thereof, a new firearm support apparatus embodying the principles and concepts of the present invention and generally designated by the reference numeral 10 will be described.

As best illustrated in FIGS. 1 through 4, the firearm support apparatus 10 generally comprises a front support assembly 11 being designed for being positioned on a support surface. The front support assembly 11 is designed for engaging the firearm whereby the front support assembly 11 is for supporting a front portion of the firearm above the support surface. The front assembly is designed for altering an angle of the firearm with respect to a target to accommodate for wind. A rail assembly 12 is operationally coupled to the front support assembly 11 whereby the front support assembly 11 is selectively positionable along a length of the rail assembly 12.

A rear support assembly 13 is operationally coupled to the rail assembly 12 opposite the front support assembly 11. The rear support assembly 13 is designed for supporting a rear portion of the firearm when the front portion of the firearm is supported by the front support assembly 11.

The front support assembly 11 comprises a base assembly 14 and a receiving assembly 15. The base assembly 14 is operationally coupled to the rail assembly 12 whereby the base assembly 14 is selectively positionable along a length of the rail assembly 12. The receiving assembly 15 is operationally coupled to the base assembly 14 whereby the receiving assembly 15 is selectively positionable at a desired height above the base assembly 14. The receiving assembly 15 is designed for receiving the front portion of the firearm whereby the receiving assembly 15 is for supporting the firearm when the fire arm is being discharged.

The base assembly 14 comprises a base member 16. The base member 16 is operationally coupled to the rail assembly 12. The base member 16 is selectively positioned along the rail assembly 12 for selectively adjusting a length between the base member 16 and the rear support assembly 13.

The base assembly 14 comprises a stanchion cylinder 17. The stanchion cylinder 17 extends upwardly from the base member 16 of the base assembly 14. The stanchion cylinder 17 comprises a bore 18 extending through the stanchion cylinder 17 whereby the stanchion cylinder 17 slidably receives a height adjustment member 19 of the receiving assembly 15 whereby the receiving assembly 15 is permitted to pivot 360 degrees and to have the height of the receiving assembly 15 above the base member 16 adjusted.

The receiving assembly 15 comprises an annular member 20. The annular member 20 is threadably coupled to the height adjustment member 19. The annular member 20 abuts the stanchion cylinder 17 of the base assembly 14 whereby rotation of the annular member 20 changes length of the height adjustment member 19 extending from the stanchion cylinder 17 to allow selective adjustment of the height of the receiving assembly 15 above the base member 16. The annular member 20 comprises knurling to facilitate gripping of the annular member 20 by the user.

The base assembly 14 comprises a washer member 21. The washer member 21 is positioned between the annular member 20 of the receiving assembly 15 and the stanchion cylinder 17 of the base assembly 14 whereby the washer member 21 is for inhibiting the annular member 20 binding on the stanchion cylinder 17. The washer member 21 is for facilitating rotation of the annular member 20 with respect to the stanchion cylinder 17 when the annular member 20 is rotated by the user.

The base assembly 14 comprises a securing member 22. The securing member 22 is operationally coupled to the stanchion cylinder 17 of the base assembly 14. The securing member 22 selectively engages the height adjustment member 19 of the receiving assembly 15 whereby the securing member 22 is for securing the receiving assembly 15 in the desired position with respect to the base member 16. The securing member 22 comprises a securing rod 23 and a securing handle 24. The securing rod 23 threadably extends through stanchion cylinder 17 and selectively engages the height adjustment member 19 of the receiving assembly 15 to secure the receiving assembly 15 in the desired position. The securing handle 24 is coupled to the securing rod 23 whereby rotation of the securing handling selectively engages and disengages to securing rod 23 from the height adjustment member 19 of the receiving assembly 15. The securing rod 23 has a tip portion comprising a pliable material, such as nylon, to prevent damage to the height adjustment member 19 when the securing rod 23 engages the height adjustment member 19.

The base assembly 14 comprises a plurality of front support members 25. Each of the front support members 25 is operationally coupled to the base member 16 whereby the front support members 25 are designed for being positioned between the support surface and the base assembly 14. The front support members 25 are designed for engaging the support surface to maintain positioning of the base member 16 when the firearm is being discharged.

Each of the front support members 25 comprise a rod portion 26 and a foot portion 27. The rod portion 26 of each of the front support members 25 is threadably coupled to the base member 16. The foot portion 27 is coupled to the rod portion 26 whereby the foot portion 27 is positioned opposite the base member 16. The foot portion 27 is designed for engaging the support surface to inhibit the base member 16 from sliding across the support surface when the firearm is discharged.

The foot portion 27 is threadably coupled to the rod portion 26 of the associated one of the front support members 25 whereby a distal end 28 of the rod portion 26 is selectively extendable from the foot portion 27. The distal end 28 of the rod portion 26 is tapered to a point whereby the point is designed for being selectively imbedded in the support surface to inhibit sliding of the base member 16 with respect to the support surface when the firearm is discharged.

Each of the front support members 25 comprise a set screw 29. The set screw 29 threadably engages the foot portion 27 of the associated one of the front support members 25 and selectively abuts against the rod portion 26 of the associated one of the front support members 25. The set screw 29 is for securing the foot portion 27 to the rod portion 26 to inhibit inadvertent rotation of the foot portion 27 with respect to the rod portion 26. The foot portion 27 of each of the front support members 25 comprises a hemi-spherical lower portion 30. The hemi-spherical lower portion 30 of the foot portion 27 allows the foot portion 27 to be positioned on angled and rough surfaces and maintain the front support assembly 11 in a level state.

At least one level indicating member 31 is coupled to the front support assembly 11. The level indicating member 31, such as a bubble level, is designed for allowing the user to determine whether the front support assembly 11 is level when the user adjusts the rod portion 26 and foot portion 27 of each of the front support members 25.

The base member 16 of the base assembly 14 comprises a pair of striking areas 32. Each of the front support members 25 is coupled to one of the striking areas 32. Each of the striking areas 32 comprises a build of material greater than the base member 16 in the areas proximate to the front support members 25. Each of the striking areas 32 are designed to receive a blow from a hammer to set the point of the rod portion 26 of the associated one front support members 25 and inhibit the associated one of the front support members 25 from being damaged by a blow from the hammer.

Each of the front support members 25 comprises a locking nut 33. The locking nut 33 is threadably coupled to the rod portion 26 of the associated one of the front support members 25 whereby the locking nut 33 is selectively positionable along a length of the rod portion 26. The locking nut 33 selectively abuts against the base member 16 to apply pressure to the rod portion 26 to inhibit inadvertent rotation of the rod portion 26 with respect to the base member 16 whereby the locking nut 33 is for maintaining a desired length of the rod portion 26 extending from the base member 16 when the locking nut 33 abuts the base member 16. The locking nut 33 is knurled to facilitate gripping of the lock nut by the user when the locking nut 33 is being turned by the user.

The front support assembly 11 comprises a locking member 34. The locking member 34 is operationally coupled to the base assembly 14. The locking member 34 selectively engages the rail assembly 12 whereby the locking member 34 is for securing the base assembly 14 at the desired position along the rail assembly 12.

The locking member 34 comprises a plate portion 35 and a handle portion 36. The handle portion 36 is threadably coupled to the base assembly 14. The plate portion 35 is coupled to the handle portion 36 whereby a portion of the rail assembly 12 is positioned between the plate portion 35 and the base assembly 14. The handle portion 36 is for selectively compressing the rail assembly 12 between the plate portion 35 of the locking member 34 and the base member 16 of the base assembly 14 to secure the base assembly 14 to the rail assembly 12 at the desired position.

The receiving assembly 15 comprises a main member 37 and a pair of block members 38. Each of the block members 38 is operationally coupled to the main member 37 whereby the block members 38 are selectively positionable along a length of the main member 37. The main member 37 is operationally coupled to the base assembly 14 whereby a height of main member 37 above of the base assembly 14 is selectable. The block members 38 are designed for receiving the front portion of the firearm whereby the block members 38 are for changing an angle of the firearm with respect to a target to account for wind when the block members 38 are selectively positioned along the main member 37.

The receiving assembly 15 comprises a slider member 39. The slider member 39 is slidably positioned in a slider channel 40 extending a portion of the length of the main member 37. Each of the block members 38 selectively engages the slider member 39 whereby the block members 38 are positioned along the length of the slider channel 40 of the main member 37 when the slider member 39 is positioned along the slider channel 40 of the main member 37 to accommodate for the wind when the firearm is discharged. The slider member 39 comprises a plastic material and the main member 37 comprises a metal material, such as aluminum. The plastic material permits a solid abutment against the metal material yet allows the slider member 39 to slide freely.

The receiving assembly 15 comprises a control rod 41. The control rod 41 is threadably coupled to the slider member 39 and extends through the main member 37. A windage knob 42 is coupled to the control rod 41 opposite the slider member 39 whereby the control rod 41 slides the slider member 39 along the slider channel 40 of the main member 37 by the rotation of the control rod 41 when the windage knob 42 is rotated by the user.

Each of the block members 38 comprises an alignment groove 43. The alignment groove 43 extends substantially perpendicular to a longitudinal axis of the associated one of the block members 38. The alignment groove 43 of each of the block members 38 selectively receives a portion of the slider member 39 whereby the alignment groove 43 of each of the block members 38 is for permitting selective positioning of the associated one of the block members 38 along a length of the slider member 39. The block member can be positioned between about 1 inch and about 3 inches apart to accommodate a stock of a variety of different of firearms.

Each of the block members 38 comprises an engaging member 44. The engaging member 44 is selectively positioned in the alignment groove 43 of the associated one of the block members 38 whereby the engaging member 44 is positioned adjacent the slider member 39 positioned in the alignment groove 43. The engaging member 44 is for selectively forcing the slider member 39 against the associated one of the block members 38 whereby the engaging member 44 inhibits sliding of the associated one of the block members 38 along the slider member 39 to secure the block members 38 in a spaced relationship when the engaging member 44 forces the slider member 39 against the associated one of the block members 38.

Each of the block members 38 comprises at least one fastening member 45. The fastening member 45 extends through the associated one of the block members 38 and is selectively coupled to the engaging member 44 of the associated one of the block members 38 whereby the fastening member 45 is for selectively engaging the engaging member 44 to the slider member 39 to inhibit movement of the associated one of the block members 38 with respect to the slider member 39 when the fastening member 45 is actuated by the user. The fastening member 45 is for disengaging the engaging member 44 from the slider member 39 to permit free movement of the associated one of the block members 38 along the slider member 39 when the fastening member 45 is actuated by the user.

A portion of each of the block members 38 comprises a pliable material, such as a foam material. The pliable material is designed for abutting against the front portion of the firearm and conforming to the shape of the firearm whereby the pliable material will not damage the firearm when the block members 38 are in contact with the firearm.

The rear support assembly 13 comprises a saddle member 46. The saddle member 46 is operationally coupled to the rail assembly 12 whereby the saddle member 46 is selectively rotatable with respect to the rail assembly 12 and a height of the saddle member 46 with respect to the rail assembly 12 is selectively adjustable. The saddle member 46 is designed for selectively receiving the rear portion of the firearm whereby the saddle member 46 supports the firearm when the firearm is being discharged. The saddle member 46 is pivotal with respect to the rail assembly 12 to allow the front support assembly 11 to change the angle of the firearm with respect to the target and not bind the firearm in the saddle member 46.

The saddle member 46 comprises an arcuate channel 47. The arcuate channel 47 extends along a length of saddle member 46. The arcuate channel 47 comprises an arcuate cross-section taken along a longitudinal axis of the saddle member 46 for permitting the arcuate channel 47 to receive the rear portion of a variety of firearms.

The saddle member 46 comprises a plastic material. The plastic material is designed to not damage the finish to the stock of the firearm when the saddle member 46 is in contact with the firearm. The saddle member 46 a pliable material, such as foam, positioned adjacent a front end of the saddle member 46 to inhibit damage to firearms, such as handguns, which are abutting the front end of the saddle material.

The rail assembly 12 comprises a rear member 48 and a pair of rail members 49. The rail members 49 are coupled to the rear member 48 whereby the rail members 49 extend outwardly from the rear member 48. The front support assembly 11 is slidably coupled to the rail members 49 whereby the front support assembly 11 is selectively postionable along a length of the rail members 49. The base member 16 of the base assembly 14 comprises a pair of rail channels 50 extending along a length of the base member 16. Each of the rail channels 50 of the base member 16 selectively receives one of the rail members 49 of the rail assembly 12. The rail members 49 of the rail assembly 12 are positioned between the plate portion 35 of the locking member 34 and the base assembly 14 whereby the rail members 49 are forced into the rail channels 50 and against the base member 16 to inhibit movement of the base assembly 14 with respect to the rail assembly 12. The rail channels 50 of the base member 16 and the rail members 49 of the rail assembly 12 each comprise a substantially square cross-section whereby the square cross-section inhibits rolling of the rail members 49 in the rail channels 50 when the plate portion 35 of the locking member 34 is compressing the rail members 49 against the base member 16. The rear support assembly 13 is coupled to the rear member 48 of the rail assembly 12.

The rear support assembly 13 comprises a height rod 51 and an adjustment sleeve 52. The height rod 51 threadably is coupled to the saddle member 46 of the rear support assembly 13 whereby the height rod 51 extends downwardly from the saddle member 46. The height rod 51 engages the adjustment sleeve 52 whereby a length of the rod extending from the adjustment sleeve 52 is adjustable to allow the height of the saddle member 46 above the adjustment sleeve 52 to be selectively adjusted by the user. The adjustment sleeve 52 slidably engages the rear member 48 of the rail assembly 12 to allow the rear support assembly 13 to pivot with respect to the rear member 48 of the rail assembly 12.

The rear support assembly 13 comprises a nut member 53. The nut member 53 threadably engages the height rod 51 of the rear support assembly 13. The nut member 53 selectively abuts the adjustment sleeve 52 whereby the nut member 53 applies pressure against the height rod 51 to inhibit inadvertent changes in height between the saddle member 46 and the adjustment sleeve 52 when the nut member 53 abuts the adjustment sleeve 52. The nut member 53 is knurled to facilitate gripping of the nut member 53 by the user when the user is rotating the nut member 53 with respect to the height rod 51.

The rail assembly 12 comprises a tensioning member 54. The tensioning member 54 is operationally coupled to the rear member 48 of the rail assembly 12 whereby the tensioning member 54 selectively engages the adjustment sleeve 52 of the rear support assembly 13. The tensioning member 54 is for inhibiting rotation of the rear support assembly 13 when the tensioning member 54 engages the adjustment sleeve 52 of the rear support assembly 13.

The rail assembly 12 comprises a cleat member 55. The cleat member 55 is coupled to the rear member 48 of the rail assembly 12 whereby the cleat member 55 extends downwardly from the rear member 48. The cleat member 55 is designed for being imbedded into the support surface to inhibit movement of the rail assembly 12 when the firearm is discharged.

An elevation assembly 56 is coupled to the front support assembly 11. The elevation assembly 56 is designed for engaging the front portion of the firearm whereby the elevation assembly 56 is designed for maintaining a desired elevation of the front portion of the firearm when the firearm is engaged by the front support assembly 11 and the rear support assembly 13.

The elevation assembly 56 comprises a horizontal rod member 57 and a vertical rod member 58. The horizontal rod member 57 is coupled to the main member 37 of the receiving assembly 15. A elevation member 59 of the elevation assembly 56 is coupled to the horizontal rod member 57 opposite the main member 37 of the receiving assembly 15. The vertical rod member 58 is coupled to the elevation member 59 whereby the vertical rod member 58 extends upwardly from the elevation member 59 whereby the vertical rod member 58 is designed for abutting against the end of the stock of the firearm to provided accurate placement of the firearm each time the fire arm is received by the front support assembly 11.

The elevation assembly 56 comprises a horizontal adjustment knob 60 and a vertical adjustment knob 61. The horizontal adjustment knob 60 is operationally coupled to the elevation member 59 of the elevation assembly 56 such that the horizontal adjustment knob 60 operationally engages the horizontal rod member 57 to allow adjustment of the positioning of the elevation member 59 along the length of the horizontal rod member 57. The vertical adjustment knob 61 being operationally coupled to the elevation member 59 of the elevation assembly 56 whereby the vertical adjustment operationally engages the vertical rod member 58 to allow selective adjustment of the length of the vertical rod member 58 extending above the elevation member 59.

In use, the user places the front support assembly 11 and rail assembly 12 on the support surface. The front support members 25 are then adjust to level the front support assembly 11. The fastening member 45 of each of the block members 38 is loosened and the block members 38 repositioned as necessary to accommodate the stock of the firearm. The front portion of the firearm is the placed between the block members 38 whereby the block members 38 support the firearm during discharge of the firearm. The rear portion of the fire arm is then placed in the arcuate channel 47 of the saddle member 46 of the rear support assembly 13 to support the firearm. The vertical rod member 58 of the elevation assembly 56 is positioned against the front end of the stock to give the user a locator to allow the firearm to be placed in the same position should the firearm be removed from the block members 38. The user can then use the windage knob 42 to adjust the positioning of the block members 38 to move the firearm to the side to account for wind conditions. The front support assembly 11 and the rear support assembly 13 support the firearm during discharge to provide a stable platform which provides a more accurate assessment of the aim of the firearm.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm support apparatus for supporting a firearm when the firearm is being discharged, the firearm support apparatus comprising:

a front support assembly being adapted for being positioned on a support surface, said front support assembly being adapted for engaging the firearm such that said front support assembly is for supporting a front portion of the firearm above the support surface, said front support assembly being adapted for altering an angle of the firearm with respect to a target to accommodate for wind;

a rail assembly being operationally coupled to said front support assembly such that said front support assembly is selectively positionable along a length of said rail assembly;

a rear support assembly being operationally coupled to said rail assembly opposite said front support assembly, said rear support assembly being adapted for supporting a rear portion of the firearm when the front portion of the firearm is supported by said front support assembly;

said front support assembly comprising a base assembly and a receiving assembly, said base assembly is operationally coupled to said rail assembly such that said base assembly is selectively positionable along a length of said rail assembly, said receiving assembly being operationally coupled to said base assembly such that said receiving assembly is selectively positionable at a desired height above said base assembly, said receiving assembly being adapted for receiving the front portion of the firearm such that said receiving assembly is for supporting the firearm when the fire arm is being discharged;

said receiving assembly comprising a main member and a pair of block members, each of said block members being operationally coupled to said main member such that said block members are selectively positionable along a length of said main member, said main member being operationally coupled to said base assembly such that a height of main member above of said base assembly is selectable, said block members being adapted for receiving the front portion of the firearm such that said block members are for changing an angle of the firearm with respect to a target to account for wind when said block members are selectively positioned along said main member; and said receiving assembly comprising a slider member, said slider member being slidably positioned in a slider channel extending a portion of the length of said main member, each of said block members selectively engaging said slider member such that said block members are positioned along the length of said slider channel of said main member when said slider member is positioned along said slider channel of said main member to accommodate for the wind when the firearm is discharged.

2. The firearm support apparatus as set forth in claim 1, further comprising:

said base assembly comprising a base member, said base member being operationally coupled to said rail assembly, said base member being selectively positioned along said rail assembly for selectively adjusting a length between said base member and said rear support assembly.

3. The firearm support apparatus as set forth in claim 2, further comprising:

said base assembly comprising a plurality of front support members, each of said front support members being operationally coupled to said base member such that said front support members are adapted for being positioned between the support surface and said base assembly, said front support members being adapted for engaging the support surface to maintain positioning of said base member when the firearm is being discharged.

4. The firearm support apparatus as set forth in claim 3, further comprising:

each of said front support members comprising a rod portion and a foot portion, said rod portion of each of said front support members being threadably coupled to said base member, said foot portion being coupled to said rod portion such that said foot portion is positioned opposite said base member relative to said rail assembly, said foot portion being adapted for engaging the support surface to inhibit said base member from sliding across the support surface when the firearm is discharged.

5. The firearm support apparatus as set forth in claim 4, further comprising:

said foot portion being threadably coupled to said rod portion of the associated one of said front support members such that a distal end of said rod portion is selectively extendable from said foot portion, said distal end of said rod portion being tapered to a point such that said point is adapted for being selectively imbedded in the support surface to inhibit sliding of said base member with respect to the support surface when the firearm is discharged.

6. The firearm support apparatus as set forth in claim 4, further comprising:

each of said front support members comprising a locking nut, said locking nut being threadably coupled to said rod portion of the associated one of said front support members such that said locking nut is selectively positionable along a length of said rod portion, said locking nut selectively abutting against said base member to apply pressure to said rod portion to inhibit inadvertent rotation of said rod portion with respect to said base member such that said locking nut is for maintaining a desired length of said rod portion extending from said base member when said locking nut abuts said base member.

7. The firearm support apparatus as set forth in claim 1, further comprising:

said front support assembly comprising a locking member, said locking member being operationally coupled to said base assembly, said locking member selectively engaging said rail assembly such that said locking member is for securing said base assembly at the desired position along said rail assembly.

8. The firearm support apparatus as set forth in claim 7, further comprising:

said locking member comprising a plate portion and a handle portion, said handle portion being threadably coupled to said base assembly, said plate portion being coupled to said handle portion such that a portion of said rail assembly is positioned between said plate portion and said base assembly, said handle portion being for selectively compressing said rail assembly between said plate portion of said locking member and said base assembly to secure said base assembly to said rail assembly at the desired position.

9. The firearm support apparatus as set forth in claim 1, further comprising:

said receiving assembly comprising a control rod, said control rod being threadably coupled to said slider member and extends through said main member, a windage knob is coupled to said control rod opposite said slider member such that said control rod slides said slider member along said slider channel of said main member by the rotation of said control rod when said windage knob is rotated by the user.

10. The firearm support apparatus as set forth in claim 1, further comprising:

each of said block members comprising an alignment groove, said alignment groove extending substantially perpendicular to a longitudinal axis of the associated one of said block members, said alignment groove of each of said block members selectively receiving a portion of said slider member such that said alignment groove of each of said block members is for permitting selective positioning of the associated one of said block members along a length of said slider member;

each of said block members comprising an engaging member, said engaging member being selectively positioned in said alignment groove of the associated one of said block members such that said engaging member is positioned adjacent said slider member positioned in said alignment groove, said engaging member being for selectively forcing said slider member against the associated one of said block members such that said engaging member inhibits sliding of the associated one of said block members along said slider member to secure said block members in a spaced relationship when said engaging member forces said slider member against the associated one of said block members.

11. The firearm support apparatus as set forth in claim 10, further comprising:

each of said block members comprising at least one fastening member, said fastening member extending through the associated one of said block members and being selectively coupled to said engaging member of the associated one of said block members such that said fastening member is for selectively engaging said engaging member to said slider member to inhibit movement of the associated one of said block members with respect to said slider member when said fastening member is actuated by the user, said fastening member being for disengaging said engaging member from said slider member to permit free movement of the associated one of said block members along said slider member when said fastening member is actuated by the user.

12. The firearm support apparatus as set forth in claim 1, further comprising:

said rear support assembly comprising a saddle member, said saddle member being operationally coupled to said rail assembly such that said saddle member is selectively rotatable with respect to said rail assembly and a height of said saddle member with respect to said rail assembly is selectively adjustable, said saddle member being adapted for selectively receiving the rear portion of the firearm such that said saddle member supports the firearm when the firearm is being discharged, said saddle member being pivotal with respect to said rail assembly to allow said front support assembly to change the angle of the firearm with respect to the target and not bind the firearm in said saddle member.

13. The firearm support apparatus as set forth in claim 12, further comprising:

said saddle member comprising an arcuate channel, said arcuate channel extending along a length of saddle member, said arcuate channel comprising an arcuate cross-section taken along a longitudinal axis of said saddle member for permitting said arcuate channel to receive the rear portion of a variety of firearms.

14. The firearm support apparatus as set forth in claim 1, further comprising:

said rail assembly comprising a rear member and a pair of rail members, said rail members being coupled to said rear member such that said rail members extend outwardly from said rear member, said front support assembly being slidably coupled to said rail members such that said front support assembly is selectively postionable along a length of said rail members, said rear support assembly being coupled to said rear member of said rail assembly.

15. The firearm support apparatus as set forth in claim 14, further comprising:

said rail assembly comprising a cleat member, said cleat member being coupled to said rear member of said rail assembly such that said cleat member extends downwardly from said rear member, said cleat member being adapted for being imbedded into the support surface to inhibit movement of said rail assembly when said firearm is discharged.

16. The firearm support apparatus as set forth in claim 1, further comprising:

an elevation assembly being coupled to said front support assembly, said elevation assembly being adapted for engaging the front portion of the firearm such that said elevation assembly is adapted for maintaining a desired elevation of the front portion of the firearm when the firearm is engaged by said front support assembly and said rear support assembly.

17. A firearm support apparatus for supporting a firearm when the firearm is being discharged, the firearm support apparatus comprising:

a front support assembly being adapted for being positioned on a support surface, said front support assembly being adapted for engaging the firearm such that said front support assembly is for supporting a front portion of the firearm above the support surface, said front support assembly being adapted for altering an angle of the firearm with respect to a target to accommodate for wind;

a rail assembly being operationally coupled to said front support assembly such that said front support assembly is selectively positionable along a length of said rail assembly;

a rear support assembly being operationally coupled to said rail assembly opposite said front support assembly, said rear support assembly being adapted for supporting a rear portion of the firearm when the front portion of the firearm is supported by said front support assembly;

said front support assembly comprising a base assembly and a receiving assembly, said base assembly is operationally coupled to said rail assembly such that said base assembly is selectively positionable along a length of said rail assembly, said receiving assembly being operationally coupled to said base assembly such that said receiving assembly is selectively positionable at a desired height above said base assembly, said receiving assembly being adapted for receiving the front portion of the firearm such that said receiving assembly is for supporting the firearm when the fire arm is being discharged;

said base assembly comprising a base member, said base member being operationally coupled to said rail assembly, said base member being selectively positioned along said rail assembly for selectively adjusting a length between said base member and said rear support assembly;

said base assembly comprising a plurality of front support members, each of said front support members being operationally coupled to said base member such that said front support members are adapted for being positioned between the support surface and said base assembly, said front support members being adapted for engaging the support surface to maintain positioning of said base member when the firearm is being discharged;

each of said front support members comprising a rod portion and a foot portion, said rod portion of each of said front support members being threadably coupled to said base member, said foot portion being coupled to said rod portion such that said foot portion is positioned opposite said base member relative to said rail assembly, said foot portion being adapted for engaging the support surface to inhibit said base member from sliding across the support surface when the firearm is discharged;

said foot portion being threadably coupled to said rod portion of the associated one of said front support members such that a distal end of said rod portion is selectively extendable from said foot portion, said distal end of said rod portion being tapered to a point such that said point is adapted for being selectively imbedded in the support surface to inhibit sliding of said base member with respect to the support surface when the firearm is discharged;

each of said front support members comprising a locking nut, said locking nut being threadably coupled to said rod portion of the associated one of said front support members such that said locking nut is selectively positionable along a length of said rod portion, said locking nut selectively abutting against said base member to apply pressure to said rod portion to inhibit inadvertent rotation of said rod portion with respect to said base member such that said locking nut is for maintaining a desired length of said rod portion extending from said base member when said locking nut abuts said base member;

said front support assembly comprising a locking member, said locking member being operationally coupled to said base assembly, said locking member selectively engaging said rail assembly such that said locking member is for securing said base assembly at the desired position along said rail assembly;

said locking member comprising a plate portion and a handle portion, said handle portion being threadably coupled to said base assembly, said plate portion being coupled to said handle portion such that a portion of said rail assembly is positioned between said plate portion and said base assembly, said handle portion being for selectively compressing said rail assembly between said plate portion of said locking member and said base assembly to secure said base assembly to said rail assembly at the desired position;

said receiving assembly comprising a main member and a pair of block members, each of said block members being operationally coupled to said main member such that said block members are selectively positionable along a length of said main member, said main member being operationally coupled to said base assembly such that a height of main member above of said base assembly is selectable, said block members being adapted for receiving the front portion of the firearm such that said block members are for changing an angle of the firearm with respect to a target to account for wind when said block members are selectively positioned along said main member;

said receiving assembly comprising a slider member, said slider member being slidably positioned in a slider channel extending a portion of the length of said main member, each of said block members selectively engaging said slider member such that said block members are positioned along the length of said slider channel of said main member when said slider member is positioned along said slider channel of said main member to accommodate for the wind when the firearm is discharged;

said receiving assembly comprising a control rod, said control rod being threadably coupled to said slider member and extends through said main member, a windage knob is coupled to said control rod opposite said slider member such that said control rod slides said slider member along said slider channel of said main member by the rotation of said control rod when said windage knob is rotated by the user;

each of said block members comprising an alignment groove, said alignment groove extending substantially perpendicular to a longitudinal axis of the associated one of said block members, said alignment groove of each of said block members selectively receiving a portion of said slider member such that said alignment groove of each of said block members is for permitting selective positioning of the associated one of said block members along a length of said slider member;

each of said block members comprising an engaging member, said engaging member being selectively positioned in said alignment groove of the associated one of said block members such that said engaging member is positioned adjacent said slider member positioned in said alignment groove, said engaging member being for selectively forcing said slider member against the associated one of said block members such that said engaging member inhibits sliding of the associated one of said block members along said slider member to secure said block members in a spaced relationship when said engaging member forces said slider member against the associated one of said block members;

each of said block members comprising at least one fastening member, said fastening member extending through the associated one of said block members and being selectively coupled to said engaging member of the associated one of said block members such that said fastening member is for selectively engaging said engaging member to said slider member to inhibit movement of the associated one of said block members with respect to said slider member when said fastening member is actuated by the user, said fastening member being for disengaging said engaging member from said slider member to permit free movement of the associated one of said block members along said slider member when said fastening member is actuated by the user;

said rear support assembly comprising a saddle member, said saddle member being operationally coupled to said rail assembly such that said saddle member is selectively rotatable with respect to said rail assembly and a height of said saddle member with respect to said rail assembly is selectively adjustable, said saddle member being adapted for selectively receiving the rear portion of the firearm such that said saddle member supports the firearm when the firearm is being discharged, said saddle member being pivotal with respect to said rail assembly to allow said front support assembly to change the angle of the firearm with respect to the target and not bind the firearm in said saddle member;

said saddle member comprising an arcuate channel, said arcuate channel extending along a length of saddle member, said arcuate channel comprising an arcuate cross-section taken along a longitudinal axis of said saddle member for permitting said arcuate channel to receive the rear portion of a variety of firearms;

said rail assembly comprising a rear member and a pair of rail members, said rail members being coupled to said rear member such that said rail members extend outwardly from said rear member, said front support assembly being slidably coupled to said rail members such that said front support assembly is selectively postionable along a length of said rail members, said rear support assembly being coupled to said rear member of said rail assembly;

said rail assembly comprising a cleat member, said cleat member being coupled to said rear member of said rail assembly such that said cleat member extends downwardly from said rear member, said cleat member being adapted for being imbedded into the support surface to inhibit movement of said rail assembly when said firearm is discharged; and an elevation assembly being coupled to said front support assembly, said elevation assembly being adapted for engaging the front portion of the firearm such that said elevation assembly is adapted for maintaining a desired elevation of the front portion of the firearm when the firearm is engaged by said front support assembly and said rear support assembly.

18. A firearm support apparatus for supporting a firearm when the firearm is being discharged, the firearm support apparatus comprising:

a front support assembly being adapted for being positioned on a support surface, said front support assembly being adapted for engaging the firearm such that said front support assembly is for supporting a front portion of the firearm above the support surface, said front support assembly being adapted for altering an angle of the firearm with respect to a target to accommodate for wind;

a rail assembly being operationally coupled to said front support assembly such that said front support assembly is selectively positionable along a length of said rail assembly;

a rear support assembly being operationally coupled to said rail assembly opposite said front support assembly, said rear support assembly being adapted for supporting a rear portion of the firearm when the front portion of the firearm is supported by said front support assembly;

said front support assembly comprising a base assembly and a receiving assembly, said base assembly is operationally coupled to said rail assembly such that said base assembly is selectively positionable along a length of said rail assembly, said receiving assembly being operationally coupled to said base assembly such that said receiving assembly is selectively positionable at a desired height above said base assembly, said receiving assembly being adapted for receiving the front portion of the firearm such that said receiving assembly is for supporting the firearm when the fire arm is being discharged;

said base assembly comprising a base member, said base member being operationally coupled to said rail assembly, said base member being selectively positioned along said rail assembly for selectively adjusting a length between said base member and said rear support assembly;

said base assembly comprising a plurality of front support members, each of said front support members being operationally coupled to said base member such that said front support members are adapted for being positioned between the support surface and said base assembly, said front support members being adapted for engaging the support surface to maintain positioning of said base member when the firearm is being discharged;

each of said front support members comprising a rod portion and a foot portion, said rod portion of each of said front support members being threadably coupled to said base member, said foot portion being coupled to said rod portion such that said foot portion is positioned opposite said base member relative to said rail assembly, said foot portion being adapted for engaging the support surface to inhibit said base member from sliding across the support surface when the firearm is discharged; and each of said front support members comprising a locking nut, said locking nut being threadably coupled to said rod portion of the associated one of said front support members such that said locking nut is selectively positionable along a length of said rod portion, said locking nut selectively abutting against said base member to apply pressure to said rod portion to inhibit inadvertent rotation of said rod portion with respect to said base member such that said locking nut is for maintaining a desired length of said rod portion extending from said base member when said locking nut abuts said base member.

19. The firearm support apparatus as set forth in claim 18, further comprising:

said foot portion being threadably coupled to said rod portion of the associated one of said front support members such that a distal end of said rod portion is selectively extendable from said foot portion, said distal end of said rod portion being tapered to a point such that said point is adapted for being selectively imbedded in the support surface to inhibit sliding of said base member with respect to the support surface when the firearm is discharged.

20. The firearm support apparatus as set forth in claim 18, further comprising:

said front support assembly comprising a locking member, said locking member being operationally coupled to said base assembly, said locking member selectively engaging said rail assembly such that said locking member is for securing said base assembly at the desired position along said rail assembly.

* * * * *